US009470191B2

(12) United States Patent
Monros

(10) Patent No.: US 9,470,191 B2
(45) Date of Patent: Oct. 18, 2016

(54) FUEL PRESSURE CONTROL SYSTEM FOR AN INTERNAL COMBUSTION ENGINE

(71) Applicant: SVMTech, LLC, Santa Ana, CA (US)

(72) Inventor: Serge V. Monros, Costa Mesa, CA (US)

( * ) Notice: Subject to any disclaimer, the term of this patent is extended or adjusted under 35 U.S.C. 154(b) by 84 days.

(21) Appl. No.: 14/561,782

(22) Filed: Dec. 5, 2014

(65) Prior Publication Data

US 2015/0159606 A1 Jun. 11, 2015

Related U.S. Application Data

(60) Provisional application No. 61/912,140, filed on Dec. 5, 2013.

(51) Int. Cl.

| | |
|---|---|
| ***F02M 69/54*** | (2006.01) |
| ***F02M 37/00*** | (2006.01) |
| *F02M 21/02* | (2006.01) |

(52) U.S. Cl.

CPC ..... *F02M 37/0029* (2013.01); *F02M 21/0233* (2013.01); *F02M 21/0239* (2013.01); *F02M 21/0242* (2013.01)

(58) Field of Classification Search

CPC ..... F02M 37/0029; F02M 21/0233; F02M 21/0239; F02M 21/0242

USPC ..... 123/457, 458, 510, 511

See application file for complete search history.

(56) References Cited

U.S. PATENT DOCUMENTS

| | | | | |
|---|---|---|---|---|
| 4,170,971 | A | 10/1979 | Yamanaka et al. | |
| 5,367,999 | A * | 11/1994 | King | F02B 43/00 123/458 |
| 5,682,845 | A * | 11/1997 | Woody | F02B 33/04 123/73 A |
| 6,131,552 | A * | 10/2000 | Paielli | F02M 21/0233 123/27 GE |
| 6,955,160 | B1 * | 10/2005 | Konopacki | F02M 21/0239 123/527 |
| 8,210,156 | B2 | 7/2012 | Kokotovic et al. | |
| 8,381,760 | B2 | 2/2013 | Santinanavat et al. | |
| 8,935,078 | B1 * | 1/2015 | Lorts | F02M 69/54 123/457 |
| 9,038,658 | B2 * | 5/2015 | Santinanavat | F23N 1/002 137/487.5 |
| 2007/0209639 | A1 | 9/2007 | Semii | |
| 2011/0213543 | A1 | 9/2011 | Bellistri et al. | |

* cited by examiner

*Primary Examiner* — Hai Huynh
(74) *Attorney, Agent, or Firm* — Kelly & Kelley, LLP

(57) ABSTRACT

A pneumatic fuel pressure regulator and a mechanical fuel pressure regulator are disclosed wherein the pneumatic fuel pressure regulator uses a mechanical adjustment screw to position a spring locator and spring force exerted on a diaphragm assembly controlling flow through a base fuel block. The mechanical fuel pressure regulator includes a stepper motor and a threaded drive shaft to control pressure exerted on a diaphragm assembly to regulate passage through a base fuel block. A dual stage system combines the pneumatic and mechanical regulators in a dual base unit having two ports separately controlled by the separate regulators.

13 Claims, 4 Drawing Sheets

FUEL PRESSURE CONTROL SYSTEM FOR AN INTERNAL COMBUSTION ENGINE

BACKGROUND OF THE INVENTION

The present invention is generally directed to a fuel pressure regulator for a motor vehicle. More particularly, the present invention is directed to a programmable electronically controlled fuel pressure regulator.

Fuel pressure regulators have been previously proposed. Spring based pressure regulators are known that use spring force to control a valve providing fluid communication to a return fuel line. However, the fuel pressure regulators of the prior art do not allow for an efficient method of varying the regulated fuel pressure. There is a need for a design that overcomes the shortcomings of the related art. The present invention fulfills these needs and provides other related advantages.

SUMMARY OF THE INVENTION

The present invention is directed to a fuel pressure control system for an internal combustion engine. The system comprises a fuel regulator block for a fuel injector. The fuel regulator block has an internal valve port and a diaphragm for regulating fuel pressure within the fuel regulator block. The system further comprises a means for mechanically adjusting a position of the diaphragm in the fuel regulator block. A microcontroller is operatively connected to the diaphragm position adjusting means and programmed to selectively open or close the internal valve port. The microcontroller preferably has multiple sensors to sense engine conditions, including fuel pressure, vacuum pressure, and/or oxygen content. The fuel regulator block preferably comprises a base unit having an inlet port and an outlet port with the internal valve port there-between.

A resilient diaphragm spring exerts a biasing force against the diaphragm. An adjustment screw engages the resilient diaphragm spring and adjusts the biasing force against the diaphragm. In one preferred embodiment, the diaphragm position adjusting means comprises a pneumatic pressure regulator disposed on the fuel regulator block for exerting positive or negative pressure on the diaphragm. In this preferred embodiment, the adjustment screw establishes a base operating position of the diaphragm within the fuel regulator block. In another preferred embodiment, the diaphragm position adjusting means comprises a motor disposed on the fuel regulator block. The motor has an output shaft mechanically coupled to a spring locator on the resilient diaphragm spring to increase or decrease the biasing force of the resilient diaphragm spring against the diaphragm.

The diaphragm is configured to seal or allow varying amounts of fuel to pass through the valve port. The fuel regulator block may comprise a two-sided base unit having an inlet port and an outlet port, with a first valve port and a second valve port there-between. In the two-sided base unit, the fuel regulator block comprises a first diaphragm operatively associated with the first valve port and a second diaphragm operatively associated with the second valve port. The first diaphragm and second diaphragm are configured to seal or allow varying amounts of fuel to pass through the first valve port and second valve port respectively.

Also in this two-sided base unit, the diaphragm position adjusting means comprises a pneumatic pressure regulator disposed on a first side of the fuel regulator block, and a motor having a threaded output shaft disposed on a second side of the fuel regulator block. The pneumatic pressure regulator exerts positive or negative pressure on the first diaphragm, and the threaded output shaft increases or decreases a biasing force exerted by a resilient diaphragm spring against the second diaphragm.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
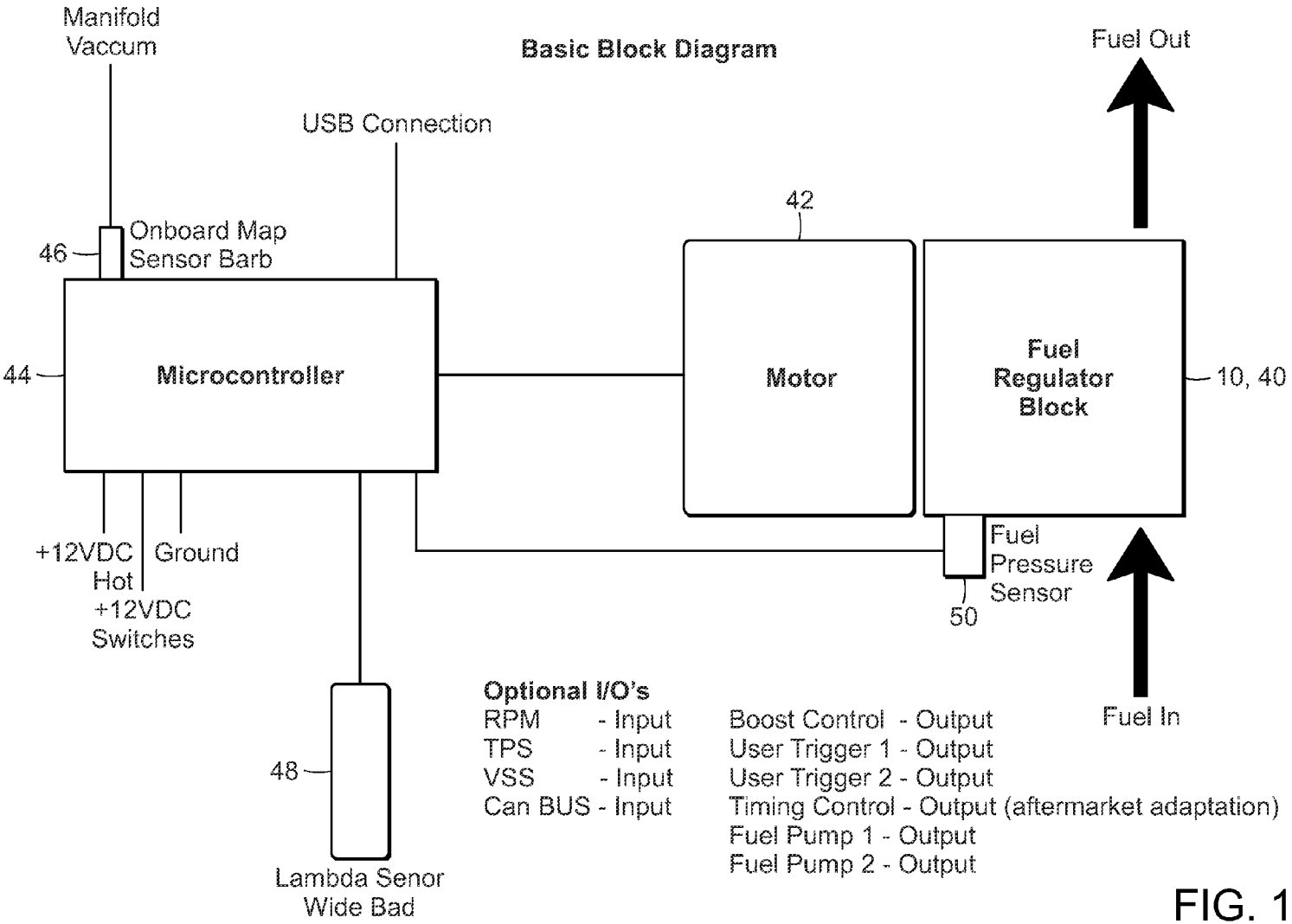
FIG. 1 is a block diagram illustrating configuration of an electronically controlled fuel pressure regulator in relation to a motor vehicle engine.

FIG. 1 illustrates a basic block diagram of an inventive fuel pressure regulator 10, 40, 72 installed in connection with an engine 42 and microcontroller 44. The regulator 40 is in line with a fuel inlet on the engine 42 and responsive to signals from the microcontroller 44. The microcontroller 44 senses various engine conditions, including but not limited to vacuum manifold, oxygen content, and fuel pressure, to mention a few. The microcontroller 44 has or is in electronic communication with a manifold vacuum sensor 46, a lambda or oxygen sensor 48, and a fuel pressure sensor 50. The lambda or oxygen sensor 48 is preferably a wide band zirconia sensor or similarly configured device. The lambda sensor 48 may also comprise a basic zirconium dioxide or zirconia sensor, or a titania made of titanium dioxide. The regulator is used by the system to control the pressure of the fuel entering the engine 42.

The microcontroller 44 preferably has a switchable lead such that voltage is supplied when the ignition key is in the on position and not supplied when the ignition key is in the off position. The microcontroller 44 may also be connected to a twelve volt non-switchable system. In this instance, the microcontroller 44 preferably has a programmable time delay to automatically shut itself off a predetermined period of time after the engine 42 stops running.

Figure 2:
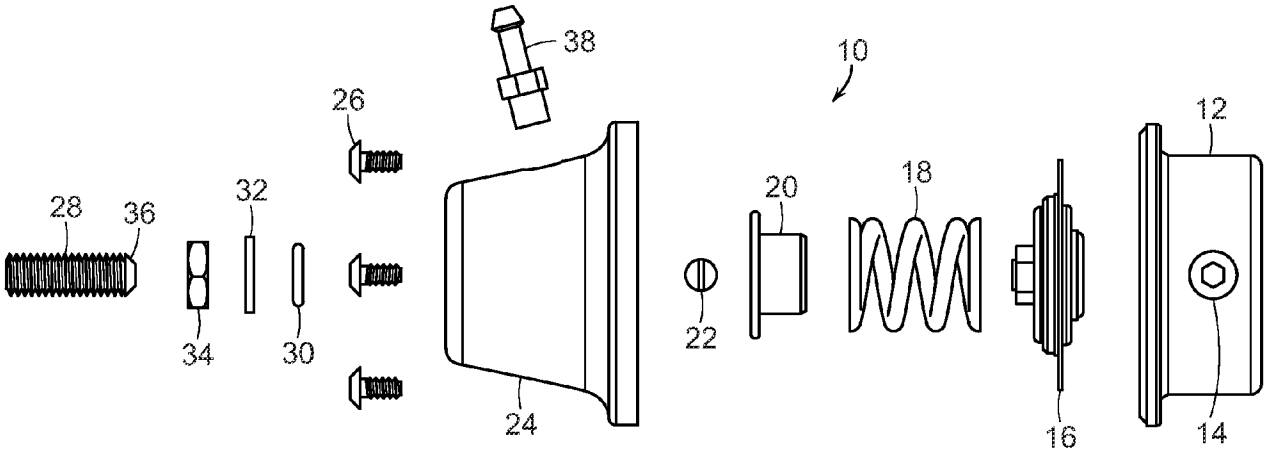
FIG. 2 is an exploded view of an electronically controlled, pneumatic adjustable fuel pressure regulator.

FIG. 2 illustrates an electronically controlled, pneumatic adjustable fuel pressure regulator 10. Regulator 10 comprises a base unit 12 having a fuel port 14 therein. The fuel port 14 communicates with an interior chamber of the base unit 12. A diaphragm assembly 16 is disposed adjacent to the base unit 12 so as to cover and be in communication with the interior chamber. A resilient diaphragm spring 18 is disposed against the diaphragm assembly 16 so as to be capable of exerting a biasing force thereupon. A spring locator 20 is disposed at the opposite end of the spring 18. A ball bearing 22 is disposed against a face surface of the spring locator 20. Typically, a recess (not shown) is included in the face surface of the spring locator 20 to partially receive the ball bearing 22.

The diaphragm assembly 16 isolates regulated fuel in the base unit or fuel block 12 from mechanical components of the regulator 10. The isolation created by the diaphragm assembly 16 provides the ability for the regulator 10 to maintain a vacuum within the housing and allows the regulator to apply or reduce pressure by a vacuum demand from the manifold pressure signal.

The diaphragm spring 18 exerts pressure on the diaphragm assembly 16 so as to transfer the energy therethrough and activate a fuel pressure regulation circuit (FIG. 5) included within the base unit 12. Simultaneously, the diaphragm spring 18 absorbs unwanted pressure spikes within the fuel supply system. The spring locator 20 acts as a centering device for the diaphragm spring as well as a seat for the mechanical adjustment screw. The check ball or ball bearing 22 acts as an intermediary device between the spring locator 20 and the adjustment screw 28. The same allows thrust and rotational forces during operation to be scrubbed off without gouging or wearing the abutting pieces.

A top cap 24 encloses the diaphragm assembly 16, spring 18, spring locator 20, and ball bearing 22, and is secured against a flange on the base unit 12. Screws 26 secure the top cap 24 to the flange of the base unit 12. An adjustment screw 28 extends through an opening (not shown) in the top cap and is sealingly held in place by a sealing ring 30, a washer 32, and a locking nut 34. The adjustment screw 28 is threaded along its length so as to have an adjustable depth into and out of the top cap 24 by action with the locking nut 34. A distal end 36 of the adjustment screw 28 is configured to engage the ball bearing 22 within the top cap 24. Movement of the adjustment screw 28 thus changes the relative position of the ball bearing 22 and the spring locator 20 so as to adjust the amount of compression on the spring 18. As the spring locator 20 is moved, the biasing force exerted by the spring 18 on the diaphragm assembly 16 either increases or decreases depending upon the direction of movement of the adjustment screw 28.

An input port 38 extends through a side wall of the top cap 24. The input port 38 allows for the creation of a vacuum or the exertion of additional pressure on the diaphragm assembly 16 within the pressure regulator 10. The fuel port 14 may either be an inlet port or an outlet port. A second port (not shown) acts as the opposite outlet or inlet for the fuel port 14. The diaphragm assembly 16 is configured to open or close a passage through the base unit 12, which passage connects the fuel port 14 to another port.

The housing cap 24 encloses the mechanical preset fuel pressure circuit as well as the vacuum port nipple 38. The nipple 38 is to allow manifold pressure to be inducted into the housing cap 24 of the regulator 10 so as to activate the primary fuel pressure circuit. The adjustment screw 28 is to set the base operating (non boost) fuel pressure within the regulator 10. Retention of the adjustment screw 28 is achieved by the sealing ring 30, washer 32, and locking nut 34. The adjustment screw 28 passes through the housing cap 24 in a threaded manner so as to be rotatably advanced and retracted from the regulator 10, thus controlling the pressure exerted on the diaphragm assembly 16 by the diaphragm spring 18.

Figure 3:
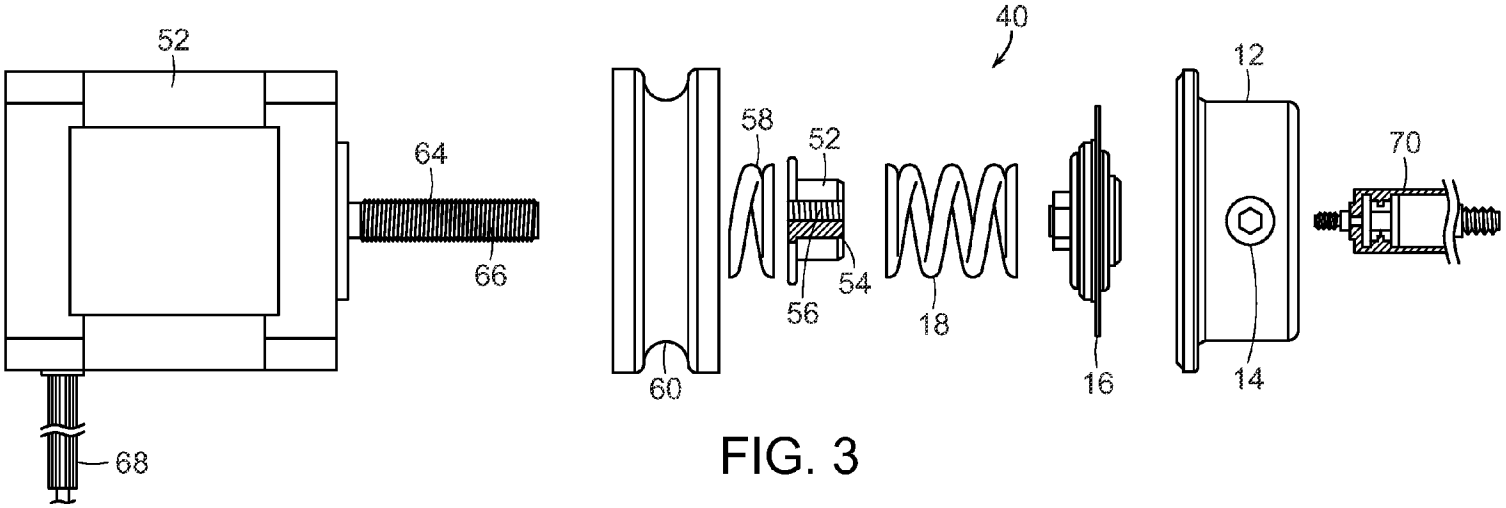
FIG. 3 is an exploded view of an electronically controlled mechanical fuel pressure regulator.

FIG. 3 illustrates a preferred embodiment of an electronically controlled mechanical fuel pressure regulator 40 according to the present invention. As with the prior art regulator 10, the inventive regulator 40 includes a base unit 12 having a fuel port 14, a diaphragm assembly 16 and a spring 18. It is at this point that the inventive regulator 40 is distinguished from the pneumatic regulator 10. The spring locator 20 is replaced by an internally threaded spring locator 52. The spring locator 52 engages the spring 18 as described above. This spring locator 52 includes a central bore 54 with internal threads 56. A retention spring 58 abuts against a face of the spring locator 52 opposite the spring 18. A coupler 60 replaces the top cap 24 and engages the flange of the base unit 12 in a manner similar to that described above.

A stepper motor 62 (or similarly configured motor) having a threaded output shaft 64 is attached to the coupler 60. The output shaft 64 extends through the coupler 60 in a sealed manner and through the retention spring 58 such that it engages the central bore 54 in the spring locator 52. External threads 66 on the output shaft 64 engage the internal threads 56 on the central bore 54 of the spring locator 52. Once so engaged, movement of the motor 62 to rotate the output shaft 64 will cause the spring locator 52 to exert a greater or lesser force on the spring 18 within the inventive regulator 40. Wiring 68 connects the stepper motor 62 to the microcontroller 44 or other control element in the system. A T-line fitted pressure transducer 70 may be affixed to the fuel port 14.

The stepper motor 62 is preferably electronically controlled by the microcontroller 44. The output shaft 64 acts as a male drive portion of a linear drive mechanism. The coupler 60 is an intermediate device that adapts the stepper motor 62 to the base unit 12. In addition, it houses the female portion of a linear drive mechanism, which includes the retention spring 58, spring locator 52, diaphragm spring 18, and diaphragm assembly 16. The retention spring 58 applies pressure to the spring locator 52 to prevent the same from separating from the diaphragm spring 18 when the stepper motor 62 draws back the linear drive mechanism in order to reduce fuel pressure. The spring locator 52 acts as a centering device for the diaphragm spring 18, as well as the female portion of the linear drive mechanism.

As with the earlier embodiment, the diaphragm spring 18 exerts pressure on the fuel isolating diaphragm assembly 16. The diaphragm assembly 16 transfers the pressure from the diaphragm spring 18 so as to activate the fuel pressure regulation circuit (FIG. 5) housed within the base unit 12. Simultaneously, the diaphragm spring 18 absorbs unwanted pressure spikes in the fuel supply system. The diaphragm assembly 16 isolates the regulated fuel in the base unit 12 from the mechanical linear drive mechanism that applies or removes pressure via the stepper motor 62.

The base unit 12 is a fuel block that houses a diaphragm fuel pressure regulation circuit (FIG. 5) that is controlled by a vacuum created by the diaphragm assembly 16. The pressure transducer 70 "reads and returns" fuel pressure readings to the microcontroller 44. The microcontroller 44 analyzes these pressure readings to determine deviation from a "desired" fuel pressure and subsequent air to fuel ratio calculations. The microcontroller 44 translates the pressure readings from the transducer 70 so as to activate the stepper motor 62 to advance or retract the linear drive mechanism so as to obtain the desired fuel pressure readings and air to fuel ratio.

Figure 4:
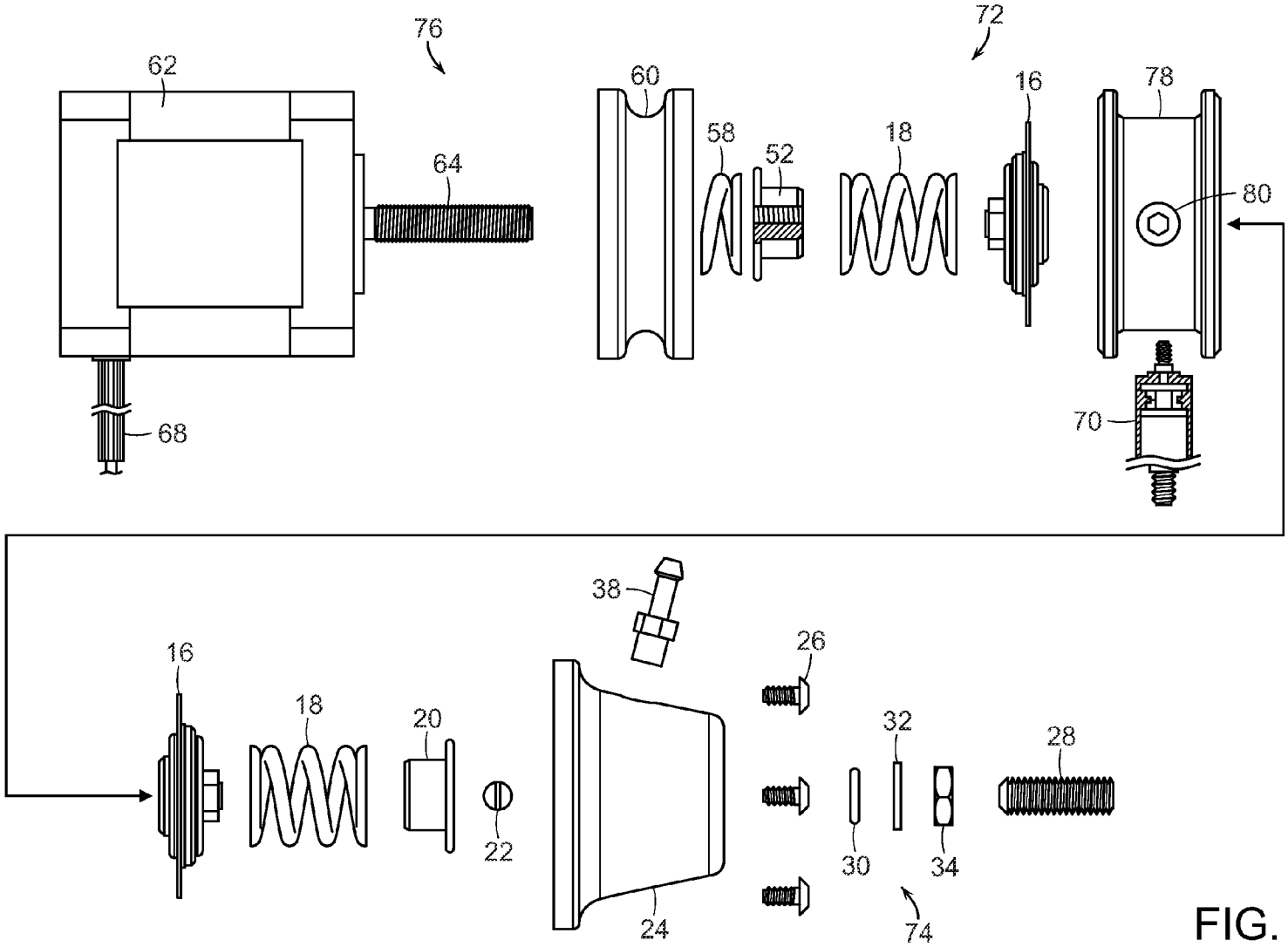
FIG. 4 is an exploded view of a dual stage electronically controlled pneumatic and mechanical fuel pressure regulator of the present invention.

FIG. 4 illustrates an alternate dual stage regulator 72. This dual stage regulator 72 combines the functionality of the pneumatic regulator 10 in a primary stage 74 and the mechanical regulator 40 in a secondary stage 76. The two stages 74, 76 are connected by a dual base unit 78 having a fuel port 80. The dual base unit 78 has the stages 74, 76 oppositely disposed such that the conventional regulator 10 and electronically controlled regulator 40 are disposed linearly. The stages may be configured in alternate orientations.

The primary and secondary stages 74, 76 are configured and operate as described above except with respect to the dual base unit 78. In the two stage unit 72, the secondary stage 76 implements the stepper motor 62 to apply and reduce pressure to the diaphragm spring 18 and the spring locator 20 in direct relation to intake manifold pressure so as to properly scale the calculated amount of fuel pressure required to obtain specific or desired air to fuel ratios when under positive manifold pressure (boost) conditions.

Figure 5:
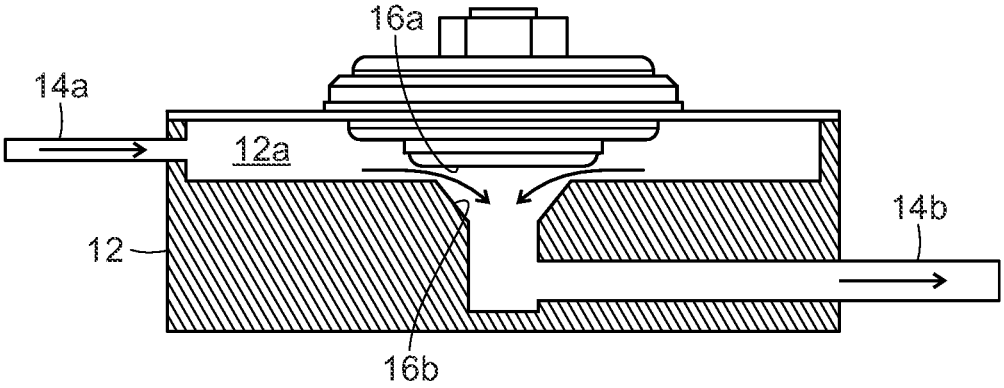
FIG. 5 illustrates a fuel pressure regulation circuit in the base unit.

FIG. 5 illustrates a version of a single stage base unit 12 having fuel inlet port 14*a* and fuel outlet port 14*b*. The diaphragm assembly 16 sits flush against a surface of the base unit 12. A valve seat 16*a* extends into an interior chamber 12*a* of the base unit 12 and is configured to engage a valve port 16*b* that connects the inlet 14*a* with the outlet 14*b*. Depending upon the pressure exerted on the diaphragm assembly 16, the valve seat 16*a* may either seal off the valve port 16*b* or allow varying levels of fluid communication through the valve port 16*b*.

Figure 6:
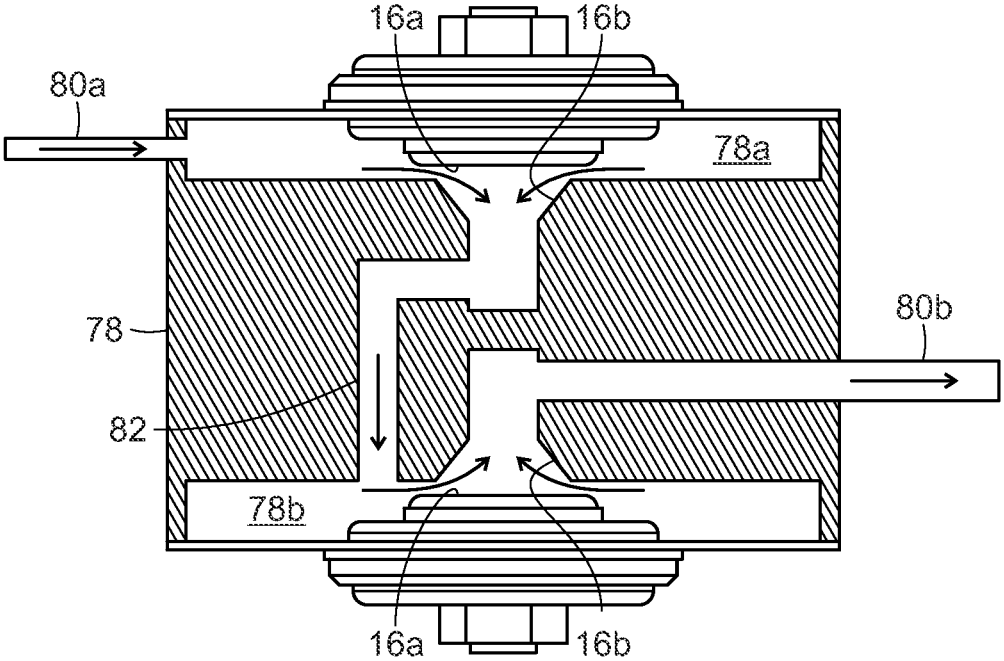
FIG. 6 illustrates a fuel pressure regulation circuit for the dual base unit.

FIG. 6 illustrates the interior of the dual base unit 78. The dual base unit 78 again has a fuel inlet 80*a* and a fuel outlet 80*b*. The respective diaphragm assemblies 16 abut against opposite surfaces of the dual base unit 78 so as to enclose interior chambers 78*a*. Each diaphragm assembly 16 again has a valve seat 16*a* and a valve port 1 6*b*. Depending upon the configuration of the respective regulators 10, 40, the valve seat 16*a* may either block valve port 16*b* or permit fluid communication therethrough. A fluid passageway 82 connects the interior chambers 78*a*, 78*b* through one of the valve ports 16*b*. In this way, the amount of fuel pressure permitted to pass through the dual base unit 78 can be adjusted by both the pneumatic regulator 10 and the mechanical regulator 40.

Although several embodiments have been described in detail for purposes of illustration, various modifications may be made without departing from the scope and spirit of the invention. Accordingly, the invention is not to be limited, except as by the appended claims.

What is claimed is:

1. A fuel pressure control system for an internal combustion engine, comprising:

a fuel regulator block for a fuel injector, the fuel regulator block having an internal valve port and a diaphragm abutting directly against a valve seat on the internal valve port for regulating fuel pressure within the fuel regulator block;

means for mechanically adjusting a position of the diaphragm relative to the valve seat; and a microcontroller operatively connected to the diaphragm position adjusting means and programmed to selectively open or close the internal valve port.

2. The fuel pressure control system of claim 1, wherein the microcontroller has multiple sensors to sense engine conditions, including fuel pressure, vacuum pressure, and/or oxygen content.

3. The fuel pressure control system of claim 1, wherein the fuel regulator block comprises a base unit having an inlet port and an outlet port with the internal valve port there-between.

4. The fuel pressure control system of any of claims 1-3, wherein the fuel regulator block comprises a resilient diaphragm spring exerting a biasing force on the diaphragm against the valve seat.

5. The fuel pressure control system of claim 4, wherein the fuel regulator block comprises an adjustment screw engaging the resilient diaphragm spring for adjusting the biasing force on the diaphragm against the valve seat.

6. The fuel pressure control system of claim 5, wherein the diaphragm position adjusting means comprises a pneumatic pressure regulator disposed on the fuel regulator block for exerting positive or negative pressure on the diaphragm.

7. The fuel pressure control system of claim 6, wherein the adjustment screw establishes a base operating position of the diaphragm within the fuel regulator block.

8. The fuel pressure control system of claim 4, wherein the diaphragm position adjusting means comprises a motor disposed on the fuel regulator block, the motor having an output shaft mechanically coupled to the resilient diaphragm spring to increase or decrease the biasing force of the resilient diaphragm spring on the diaphragm against the valve seat.

9. The fuel pressure control system of claim 4, wherein the diaphragm and valve seat are configured to seal or allow varying amounts of fuel to pass through the internal valve port.

10. The fuel pressure control system of claim 4, wherein the fuel regulator block comprises a two-sided base unit having an inlet port and an outlet port, with a first valve port and a second valve port there-between.

11. The fuel pressure control system of claim 10, wherein the fuel regulator block comprises a first diaphragm operatively associated with a first valve seat on the first valve port and a second diaphragm operatively associated with a second valve seat on the second valve port, wherein the first diaphragm with the first valve seat and the second diaphragm with the second valve seat are configured to seal or allow varying amounts of fuel to pass through the first valve port and second valve port respectively.

12. The fuel pressure control system of claim 11, wherein the diaphragm position adjusting means comprises a pneumatic pressure regulator disposed on a first side of the fuel regulator block, and a motor having a threaded output shaft disposed on a second side of the fuel regulator block.

13. The fuel pressure control system of claim 12, wherein the pneumatic pressure regulator exerts positive or negative pressure on the first diaphragm against the first valve seat, and the threaded output shaft increases or decreases a biasing force exerted by a resilient diaphragm spring on the second diaphragm against the second valve seat.

* * * * *